US007376373B2

(12) United States Patent
Kim et al.

(10) Patent No.: US 7,376,373 B2
(45) Date of Patent: May 20, 2008

(54) IMAGE FORMING APPARATUS HAVING A POWER TRANSMITTING DEVICE TO SELECTIVELY OPERATE DEVELOPING UNITS THEREOF

(75) Inventors: Sung-dae Kim, Suwon-si (KR); Cheol-young Han, Yongin-si (KR); Hae-seog Jo, Yongin-si (KR); Young-min Yoon, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 173 days.

(21) Appl. No.: 11/338,737

(22) Filed: Jan. 25, 2006

(65) Prior Publication Data

US 2006/0239716 A1 Oct. 26, 2006

(30) Foreign Application Priority Data

Apr. 20, 2005 (KR) ..... 10-2005-0032765

(51) Int. Cl.
*G03G 15/01* (2006.01)

(52) U.S. Cl. ..... 399/228; 399/54; 399/75; 399/223

(58) Field of Classification Search ..... 399/228, 399/223, 225, 53, 54, 75
See application file for complete search history.

(56) References Cited

U.S. PATENT DOCUMENTS 5,099,278 A * 3/1992 Sato ..... 399/75
5,168,319 A 12/1992 Kimura
5,828,934 A * 10/1998 Tamura et al. ..... 399/228
2003/0138270 A1 7/2003 Matsuoka
2006/0165427 A1* 7/2006 Jung et al. ..... 399/54

FOREIGN PATENT DOCUMENTS

| | | |
|---|---|---|
| EP | 0410730 | 7/1990 |
| JP | 03-087770 | 4/1991 |
| JP | 05061315 | 3/1993 |
| JP | 05341589 | 12/1993 |
| JP | 10-148985 | 6/1998 |
| JP | 2002-099129 | 4/2002 |
| JP | 2002099129 | 4/2002 |
| JP | 2003-208024 | 7/2003 |
| KR | 1020030061248 | 7/2003 |
| KR | 1020040009173 | 1/2004 |

* cited by examiner

*Primary Examiner*—Sophia S. Chen
(74) *Attorney, Agent, or Firm*—Roylance, Abrams, Berdo & Goodman, LLP

(57) ABSTRACT

An electrophotographic image forming apparatus is provided that includes a plurality of developing units, a cam shaft, and a plurality of cams disposed on the cam shaft corresponding to the respective developing units. A power transmitting device disposed between the developing units and the cams selectively transmits rotational force from a driving source to the plurality of developing units.

21 Claims, 11 Drawing Sheets

IMAGE FORMING APPARATUS HAVING A POWER TRANSMITTING DEVICE TO SELECTIVELY OPERATE DEVELOPING UNITS THEREOF

CROSS REFERENCE TO RELATED APPLICATION

This application claims the benefit under 35 U.S.C. § 119(a) of Korean Patent Application No. 10-2005-0032765, filed on Apr. 20, 2005 in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus for printing a color image by sequentially operating a plurality of developers.

2. Description of the Related Art

Generally, an electrophotographic color image forming apparatus forms a color image by forming an electrostatic latent image on a photosensitive medium charged with a uniform electric potential by emitting a beam onto the photosensitive medium. The electrostatic image is developed with a toner of a predetermined color. The developed image is transferred and fixed onto print paper. Toner colors used in the color image forming apparatus are usually yellow (Y), magenta (M), cyan (C), and black (K). Therefore, four developing units are required to adhere the toners with the four colors on the electrostatic latent image.

Methods of forming a color image include a single path method in which four exposure units and four photosensitive media are used, and a multi-pass method in which a single exposure unit and a single photosensitive medium are used. A color image forming apparatus adopting the single pass method takes the same time for color printing and black and white printing, and thus, is usually used in a high-speed image forming apparatus. However, because it has four exposure units and four photosensitive media, the price of a color image forming apparatus adopting the single pass method is high. However, a color image forming apparatus operates at a relatively low speed and has a single photosensitive medium and a single exposure unit and adopts the multi-pass method in which exposing, developing, and transferring images are repeatedly performed for each of the colors to form a color image on an intermediary medium and then transferring the color image onto print paper.

In an image forming apparatus using the multi-pass method, the four developing units operate sequentially. Thus, a device for sequentially transmitting the rotational force of a driving motor to the four developing units is required. A conventional image forming apparatus includes four electronic clutches. The electronic clutches are expensive and result in an increased size of the image forming apparatus. Additionally, slipping occurs during a clutching operation, and thus, power is not timely transmitted.

Accordingly, a need exists for an improved image forming apparatus using a multi-pass method in which the plurality of developing units are selectively operated.

SUMMARY OF THE INVENTION

Embodiments of the present invention provide an image forming apparatus using a multi-pass method capable of reliably controlling power transmitted to a developer and enabling miniaturization and reduced cost of the image forming apparatus.

According to an aspect of embodiments of the present invention, an electrophotographic image forming apparatus includes a plurality of developing units; a cam shaft; a plurality of cams disposed on the cam shaft corresponding to the respective plurality of developing units; and a power transmitting device disposed between the developing units and the cams to selectively transmit rotational force of a driving source to the plurality of developing units.

The power transmitting device may include a plurality of fixed hubs respectively connected to the developing units; and a plurality of sliding hubs connected to the driving source and adapted to respectively slide to selectively connect to the fixed hubs.

The fixed hubs and the sliding hubs may be disposed on the same axis.

The electrophotographic image forming apparatus may further include a plurality of elastic elements that respectively elastically bias the sliding hubs away from the fixed hubs.

The cam shaft may include a plurality of cam shafts connected by a universal joint.

The electrophotographic image forming apparatus may further include a connection element that pushes the sliding hub when pivoted by the cam.

The cam shaft may be rotated by the driving source, and the electrophotographic image forming apparatus may further include a regulating element that regulates the rotational force transmitted from the driving source to the cam shaft. The regulating element may include a spring clutch that is disposed between the driving source and the cam shaft. The spring clutch includes a plurality of coupling portions corresponding to the phases of the cams, and an actuator selectively coupled to the coupling portions to selectively operate the spring clutch. The electrophotographic image forming apparatus may further include a home position indicating element formed on the cam shaft; and a sensor for sensing the home position indicating element. The spring clutch may further include a home position coupling portion located at the same phase as the home position indicating element. The phase of the home position coupling portion may not overlap with the phases of the coupling portions.

The electrophotographic image forming apparatus may further include a step motor that rotates the cam shaft; a home position indicating element formed on the cam shaft; and a sensor for sensing the home position indicating element.

According to another aspect of embodiments of the present invention, a multi-pass-type electrophotographic image forming apparatus sequentially develops a single-color toner image on a photosensitive drum using a plurality of developing units facing the photosensitive drum and prints a color image by transferring the single-color toner images on top of each other on an intermediary transfer medium. The electrophotographic image forming apparatus includes a plurality of fixed hubs respectively connected to the developing units; a plurality of sliding hubs connected to a driving source and slidably disposed on the same axis as the fixed hubs; a plurality of elastic elements that respectively elastically bias the sliding hubs away from the fixed hubs; a cam shaft; and a plurality of cams disposed on the cam shaft corresponding to the respective sliding hubs, and selectively slide the sliding hubs according to the rotational phase of the cam shaft to connect the sliding hubs to the fixed hubs.

According to another aspect of embodiments of the present invention, a multi-pass-type electrophotographic image forming apparatus sequentially develops a single-color toner image on a photosensitive drum using a plurality of developing units facing the photosensitive drum and prints a color image by transferring the single-color toner images on top of each other on an intermediary transfer medium. The electrophotographic image forming apparatus includes a plurality of fixed hubs respectively connected to the developing units; a plurality of sliding hubs connected to a driving source, and slidably disposed on the same axis as the fixed hubs; a plurality of elastic elements that respectively elastically bias the sliding hubs away from the fixed hubs; a first cam shaft and a second cam shaft connected via a universal joint; and a plurality of cams disposed on the first and second cam shafts corresponding to the sliding hubs, and selectively slide the sliding hubs according to the rotational phase of the cam shaft to connect the sliding hubs to the fixed hubs.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Exemplary embodiments of the present invention will now be described more fully with reference to the accompanying drawings, in which exemplary embodiments of the invention are shown.

Figure 1:
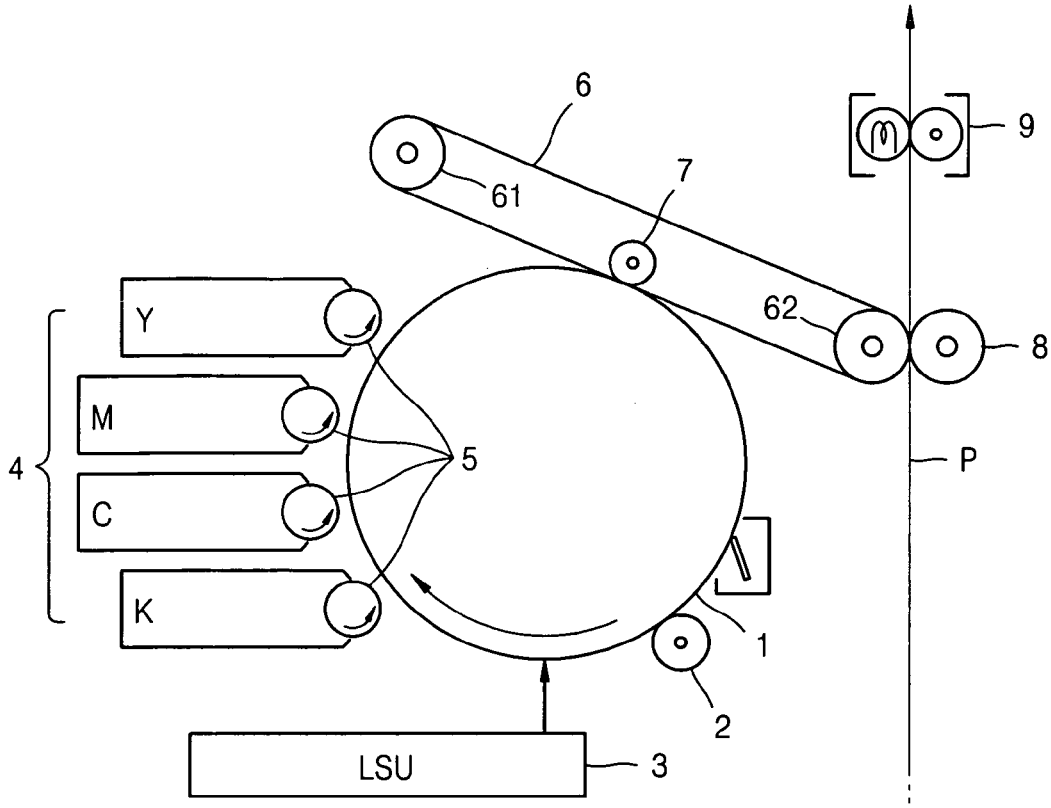
FIG. 1 is a schematic diagram of an electrophotographic image forming apparatus according to an exemplary embodiment of the present invention.

FIG. 1 is a schematic structural diagram of an electrophotographic image forming apparatus according to an exemplary embodiment of the present invention. Referring to FIG. 1, the electrophotographic image forming apparatus includes a photosensitive drum 1, a charging roller 2, an exposure unit 3, four developing units 4, an intermediate transfer belt 6, a first transfer roller 7, a second transfer roller 8, and a fixing unit 9.

Figure 12:
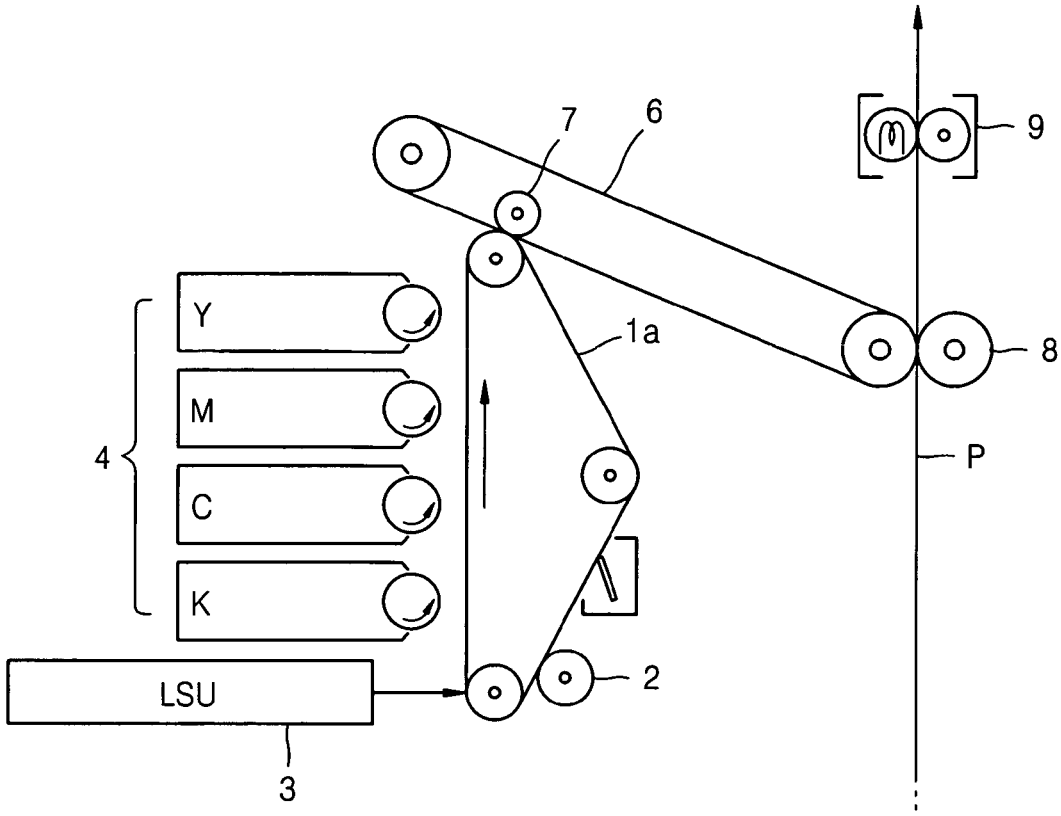
FIG. 12 is a schematic structural diagram of an electrophotographic image forming apparatus according to another exemplary embodiment of the present invention.

The photosensitive drum 1 is a cylindrical metal drum of which the outer circumference is provided with an optical conductive layer. Instead of the photosensitive drum 1, a photosensitive belt 1*a* may be used, as illustrated in FIG. 12. The charging roller 2 is an example of a charging unit that charges the photosensitive drum 1 with a uniform potential. The charging roller 2 charges the outer circumference of the photosensitive drum 1 with a uniform potential by supplying electrical charges to the outer circumference of the photosensitive drum 1 while rotating in contact or not in contact with the outer circumference of the photosensitive drum 1. A corona discharger (not shown) may be used instead of the charging roller 2. The exposure unit 3 emits light corresponding to image information onto the photosensitive drum 1 charged with a uniform potential to form an electrostatic latent image. A laser scanning unit (LSU), which usually includes a laser diode as a light source, is preferably used as the exposure unit 3.

The electrophotographic image forming apparatus of the exemplary embodiment uses cyan (C), magenta (M), yellow (Y), and black (K) toners to print a color image. Hereinafter, when there is a need to differentiate components according to their colors, Y, M, C, and K will be added at the end of the reference number to distinguish each of the color components.

The four developing units 4 respectively accommodate cyan, magenta, yellow, and black toners. Each of the developing units 4 includes a developing roller 5. The developing units 4 perform non-contact developing by being separated from the developing roller 5 by as much as a developing gap. The developing gap may be tens to hundreds of microns. Each of the developing units 4 may further include a supplying roller (not shown), an agitator (not shown), and other suitable conventional devices.

The intermediary transfer belt 6 is supported by support rollers 61 and 62 and travels at substantially the same speed as the circumference of the photosensitive drum 1. The length of the intermediary transfer belt 6 is substantially equal to or greater than the length of the maximum sized print paper P used in the electrophotographic image forming apparatus. The first transfer roller 7 faces the photosensitive drum 1, and a first transfer bias is supplied to the first transfer roller 7 so that a toner image developed on the photosensitive drum 1 is transferred to the intermediary transfer belt 6. The second transfer roller 8 is separated from the intermediary transfer belt 6 while the toner image is transferred from the photosensitive drum 1 to the intermediary transfer belt 6. When the toner image is completely transferred to the intermediary transfer belt 6, the second transfer roller 8 contacts the intermediary transfer belt 6 with a predetermined pressure. A second transfer bias used to transfer the toner image onto the print paper P is supplied to the second transfer roller 8.

A process of forming a color image using the electrophotographic image forming apparatus of the exemplary embodiment is briefly described. The exposure unit 3 emits light corresponding to, for example, yellow color image information onto the photosensitive drum 1 charged with a uniform potential by the charging roller 2. An electrostatic latent image corresponding to a yellow color image is formed on the photosensitive drum 1. A developing bias is supplied to the developing roller 5 of the yellow color developing unit 4Y. Then, the yellow toner adheres to the electrostatic latent image, thereby forming a yellow color toner image on the photosensitive drum 1. The yellow color toner image is transferred onto the intermediary transfer belt 6 due to the first transfer bias supplied to the first transfer roller 7. After transferring the yellow color toner image of a page is completed, the exposure unit 3 emits light corresponding to, for example, magenta color image information onto the photosensitive drum 1 recharged with a uniform potential by the charging roller 2, thereby forming an electrostatic latent image corresponding to the magenta color image. The magenta developing unit 4M develops the electrostatic latent image by supplying a magenta toner thereto. The magenta color toner image formed on the photosensitive drum 1 is transferred to the intermediary transfer belt 6 to overlap the yellow toner image. The same process is also performed for the cyan and black colors, and a color toner image is produced by overlapping the yellow, magenta, cyan, and black color toner images. The color toner image is transferred onto the print paper P passing between the intermediary transfer belt 6 and the second transfer belt 8 due to the second transfer bias. The fixing unit 9 fixes the color toner image onto the print paper P through heat and pressure. Through the process described above, an image may be formed by the electrophotographic image forming apparatus of the present invention.

As described above, a plurality of developing units 4 are sequentially operated in the multi-pass type color image forming apparatus. For example, a developing bias may be supplied to the developing roller 5Y of the selected developing unit 4Y. A developing bias may not be supplied or a developing preventing bias may be supplied to the rest of the developing units 4M, 4C and 4K. Also, the developing roller 5Y of the selected developing unit 4Y may rotate, while the developing rollers 5M, 5C, and 5K of the rest of the developing units 4M, 4C, and 4K may not rotate. To this end, the electrophotographic image forming apparatus includes a power transmitting device to selectively transmit a driving force to the plurality of developing units 4 and a cam device to operate the power transmitting element.

Figure 5:
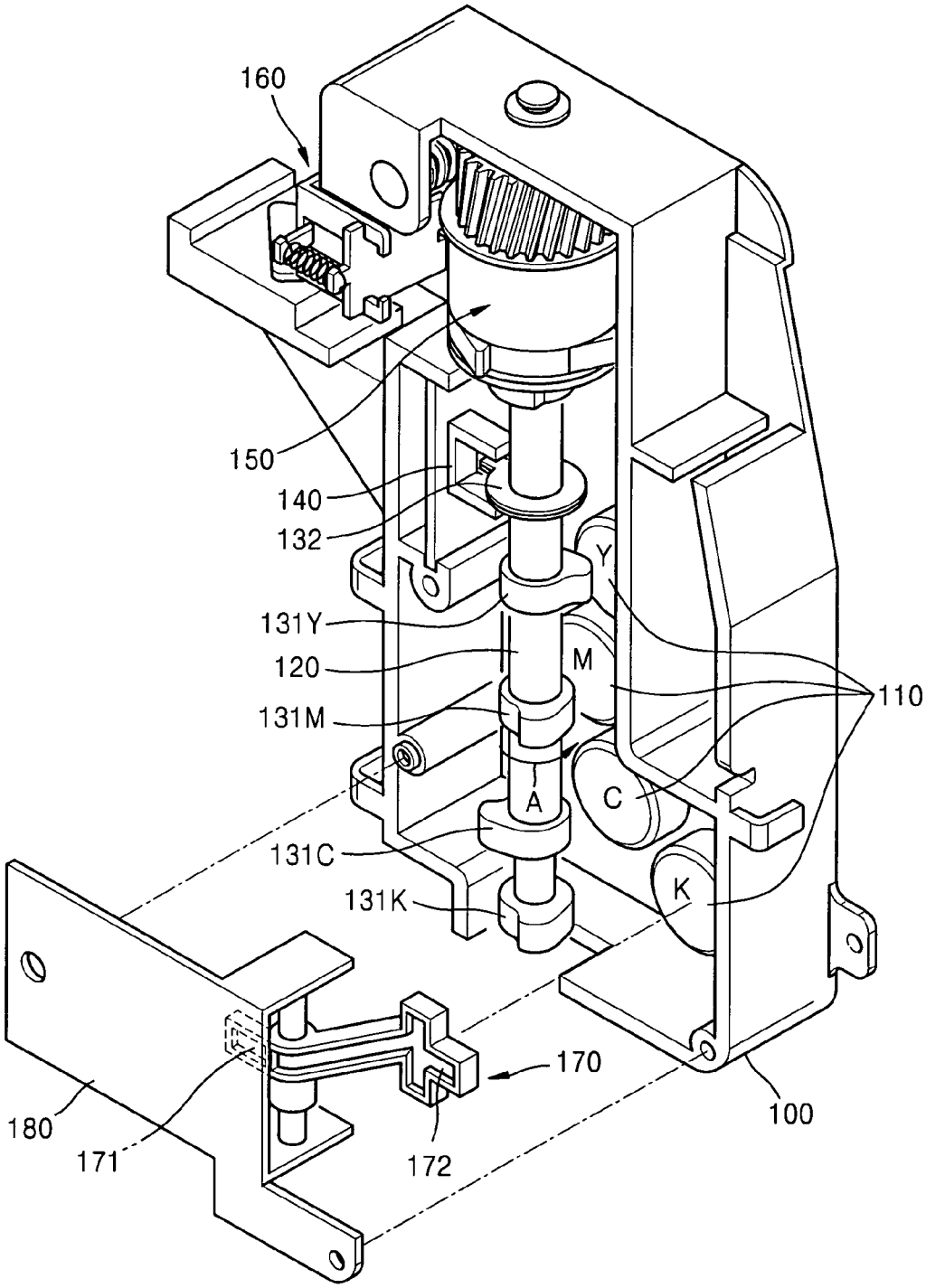
Figure 6:
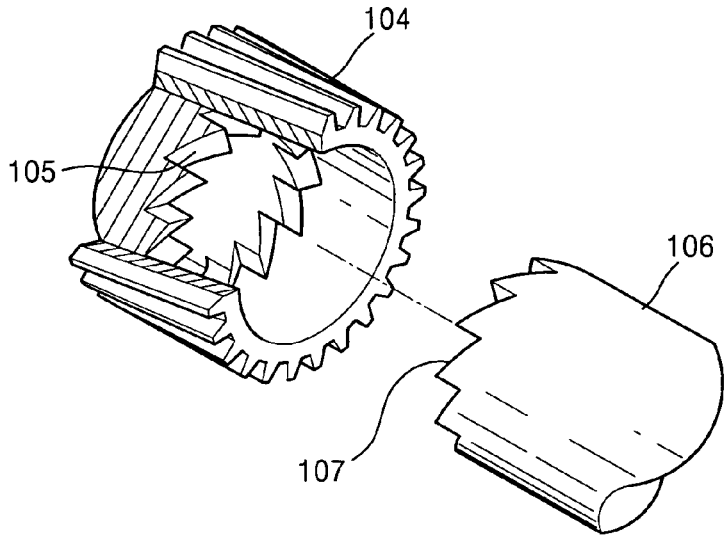
FIG. 6 is a perspective view of a sliding hub and a fixed hub of the device of FIG. 2.

FIGS. 2 through 5 are top plan and perspective views of a power transmitting device that selectively transmits driving power to the four developing units 4 according to an exemplary embodiment of the present invention. Referring to FIGS. 2 through 5, four shafts 101 are rotatably installed on a bracket 100. Each of the shafts 101 includes a cylindrical portion 102 and a D-cut portion 103. A sliding hub 104 is installed on the cylindrical portion 102. A fixed hub 106 is installed on one end of the D-cut portion 103 and a driving gear 109 is installed on the other end of the D-cut portion 103. An elastic element 112 elastically biases the sliding hub 104 away from the fixed hub 106. The sliding hub 104Y is connected to a driving motor (a driving source) 10 via gears 11 and 12. The sliding hub 104Y and the sliding hub 104M are connected via a gear 13. Although not illustrated, the sliding hub 104C is connected to the driving motor 10 via a plurality of gears. The sliding hub 104C and the sliding hub 104K are connected via a gear 14. The sliding hubs 104 and the fixed hubs 106 each include meshing portions 105 and 107 having intercomplementary shapes, as illustrated in FIG. 6. Therefore, when the sliding hub 104 and the fixed hub 106 mesh, the driving force of the driving motor 10 is transmitted to the fixed hub 106, thereby rotating the shaft 101 and the driving gear 109. The driving gear 109 is connected to an idle gear (not shown). The idle gear is connected to the developing rollers 5, as well as to other driving elements installed inside the developing units 4.

According to the above-described structure of the exemplary embodiment, the four developing units 4 may be selectively driven by selectively sliding the four sliding hubs 104 to mesh with the four fixed hubs 106. Although the four sliding hubs 104 and the four fixed hubs 106 are located on the same axis in the exemplary embodiment, the scope of the present invention is not limited thereto.

It is also possible to include a gear unit (not shown) on the fixed hub 106 to mesh with the idle gear and not include the driving gear 109. Also, only the four shafts 101 may be included and a fixed hub 106 on which a gear unit (not shown) that meshes with the idle gear 109 is formed may be rotatably installed on the shaft 101. Alternatively, the fixed hub 106 may be installed on the developing unit 4. Other structures besides those mentioned here are also possible.

Referring to FIGS. 2, 3, 5, and 7, the electrophotographic image forming apparatus includes a cam shaft 120 and four cams 131 to selectively slide the four sliding hubs 104. The four cams 131 are formed on the cam shaft 120 corresponding to the four sliding hubs 104. In the present exemplary embodiment, the four cams 131 and the cam shaft 120 are preferably formed of injection molded plastic as a single body. The phases of the four cams 131 are different. When the cam shaft 120 rotates, the four cams 131 sequentially push the four sliding hubs 104, thereby coupling the sliding hubs 104 to the respective fixed hubs 106. The electrophotographic image forming apparatus of the present exemplary embodiment includes four push caps 110. The cams 131 push the push caps 110, thereby sliding the sliding hubs 104. Alternatively, the cams 131 may directly push the sliding hubs 104.

Figure 8:
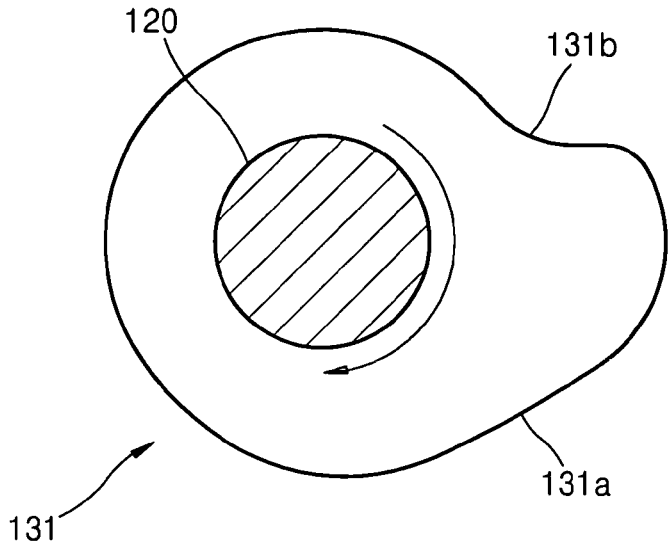
FIG. 8 is an elevational view in partial cross section of a cam on the cam shaft of FIG. 7.

The cam 131 has a first locus 131*a* that smoothly couples the sliding hub 104 to the fixed hub 106 and a second locus 131*b* that allows the sliding hub 104 to quickly separate from the fixed hub 106, as illustrated in FIG. 8. The first locus 131*a* for coupling the sliding hub 104 to the fixed hub 106 may have a large radius of curvature. The radius of curvature of the second locus 131*b* may be smaller. The sliding hub 104 may quickly separate from the fixed hub 106 so that two pairs of adjacent sliding and fixed hubs 104 and 106 are not simultaneously connected.

Referring to FIG. 1, because the developing units 4 are disposed in a circular arc along the outer circumference of the photosensitive drum 1, the push caps 110, the sliding hubs 104, the fixed hubs 106, and the driving gears 109 are also disposed in a circular arc. Preferably, the four cams 131 are disposed in a circular arc, but this may be difficult because the cam shaft 120 is usually straight. For example, referring to FIG. 5, the cams 131Y, 131M and 131C respectively push the corresponding push caps 110Y, 110M, and 10C. However, the cam 131K cannot push the corresponding push cap 110K because the cam 131K is far away from the push cam 110K. Therefore, a connection element 170 is provided to connect the cam 131K and the push cap 110K as illustrated in FIG. 5. As an example, the connection element 170 may be pivotably coupled to a cover 180. The cover 180 is coupled to the bracket 100. When the cam 131K pushes a first end 171 of the connection element 170, the connection element 170 pivots and the second end 172 of the connection element 170 pushes the push cap 110K.

Figure 7:
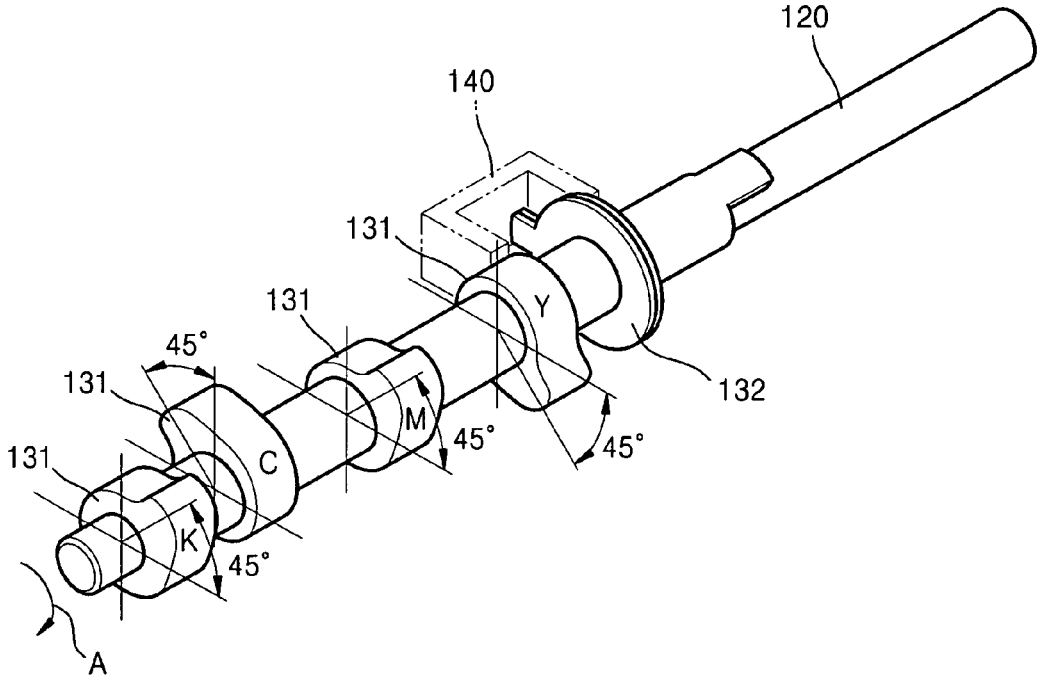
FIG. 7 is a perspective view of a cam shaft of the device of FIG. 2.

The cams 131Y, 131M, 131C, and 131K are disposed as illustrated in FIG. 7. The cams 131M and 131C are respectively disposed at approximately 90 and 180 degrees opposite to the rotation direction A of the cam 131Y and the cam shaft 120. The cam 131K pushes the corresponding push cap 110K by operating the connection element 170. The first end 171 of the connection element 170 is disposed opposite to the push cap 110K. Therefore, the cam 131K is disposed at approximately 270 degrees opposite to the rotation direction A of the cam 131C and the cam shaft 120.

The push cap 110K may be removed so that the second end 172 of the connection element 170 directly pushes the sliding hub 104K. The connection element 170 is not limited to that illustrated in FIG. 5 and may be formed in various shapes or structures that slide the corresponding sliding hub 104K when the cam 131K operates. Additionally, although not illustrated, it is possible to include a plurality of connection elements 170 according to the phases of the developing units 4. If the photosensitive belt 1*a* is used instead of the photosensitive drum 1, as illustrated in FIG. 12, the developing units 4 are disposed in a straight line, and thus, the connection element 170 may be removed.

Figure 13:
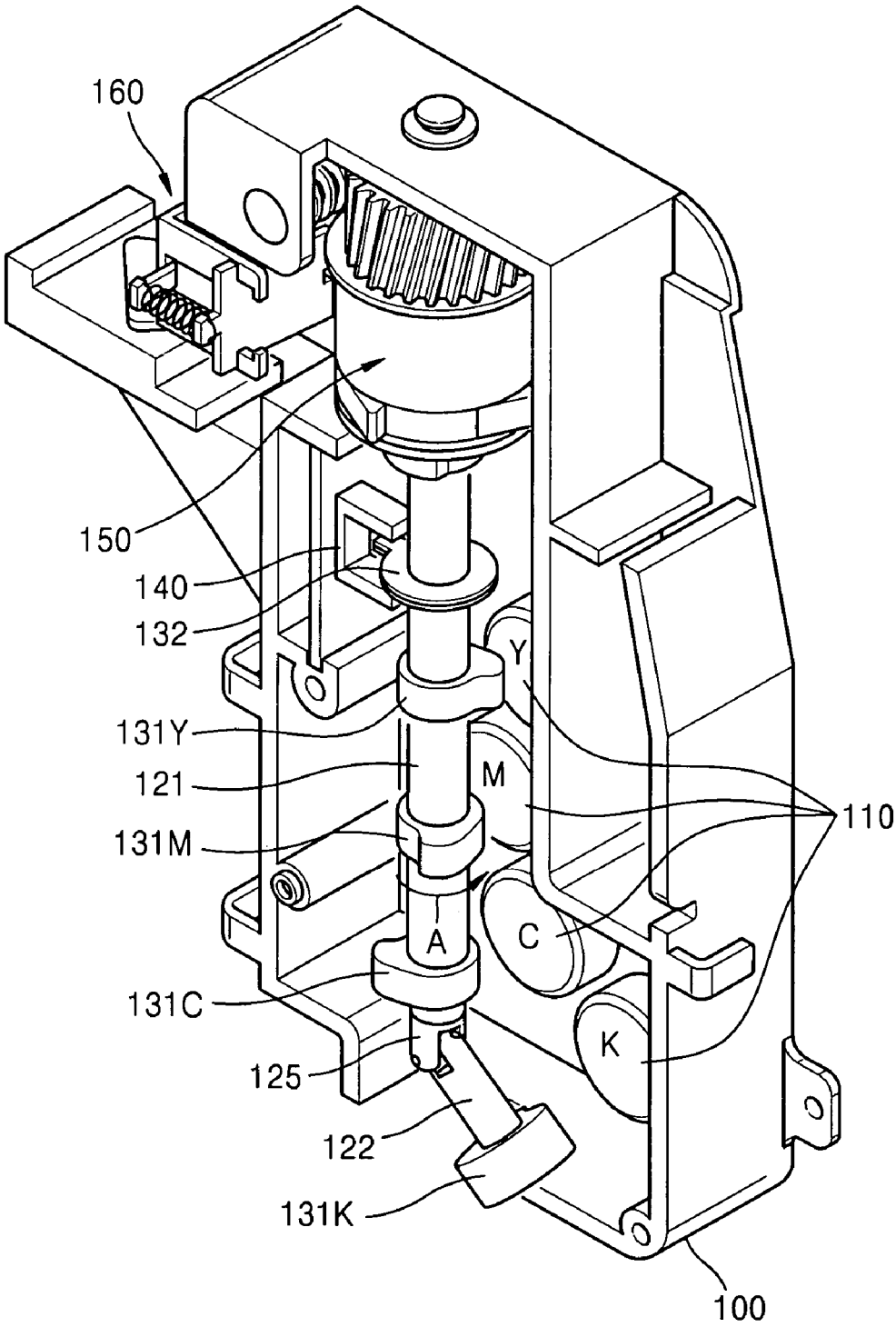
FIG. 13 is a perspective view of a power transmitting device for selectively driving a plurality of developers of an electrophotographic image forming apparatus according to another exemplary embodiment of the present invention.

It is also possible to include a plurality of cam shafts instead of the connection element 170. For example, first and second cam shafts 121 and 122 connected via a universal joint 125 may be included, as illustrated in FIG. 13. In this case, the cams 131Y, 131M, and 131C are disposed on the first cam shaft 121 and the cam 131K is disposed on the second cam shaft 122. A home position indicating element 132 is formed on the first cam shaft 121. When the first cam shaft 121 is rotated by the driving motor 10, the second cam shaft 122 also rotates at the same speed due to the universal joint 125. A spring clutch 150 controls the rotational force transmitted from the driving motor 10 to the first cam shaft 121.

The cam shaft 120 is rotated by the driving motor 10, which drives at least one of the other components of the electrophotographic image forming apparatus (e.g., the photosensitive drum 1, the charging roller 2, the intermediary belt 6, the first and second transfer rollers 7 and 8, and the fixing unit 9). The cam shaft 120 rotates only when the rotational force of the driving motor 10 transmitted to the developing units 4 is cut off. To do this, the electrophotographic image forming apparatus includes a regulating element which regulates the rotational force of the driving motor 10 transmitted to the cam shaft 120. For example, the regulating element may include the spring clutch 150 coupled to the cam shaft 120, and a solenoid (actuator) 160 for selectively operating the spring clutch 150.

Figure 9:
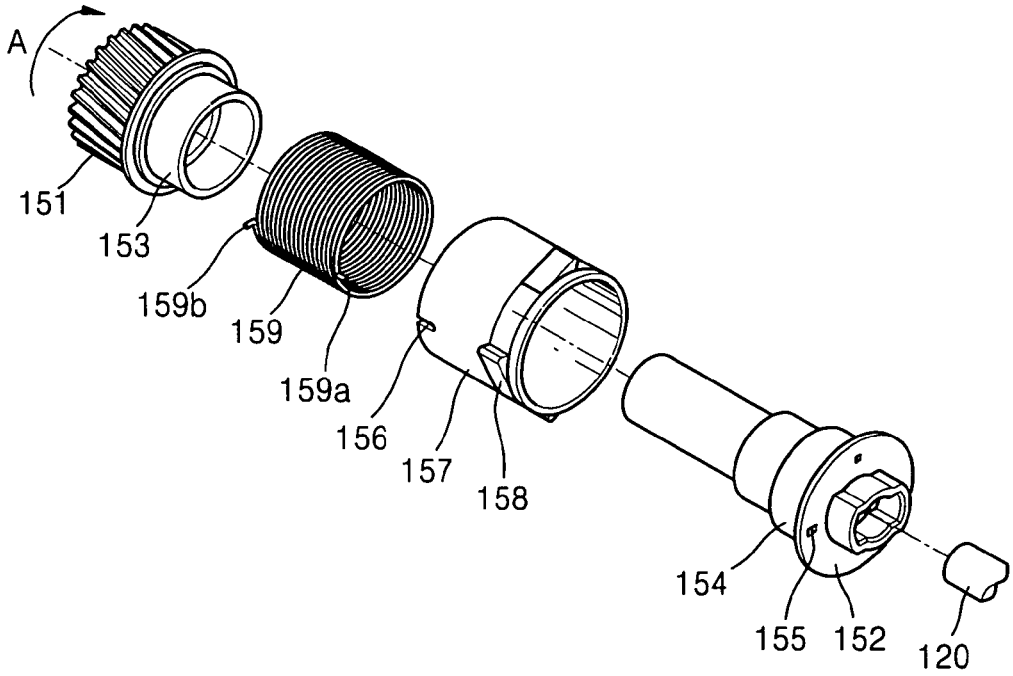
FIG. 9 is an exploded perspective view of a spring clutch of the device of FIG. 2.

FIG. 9 is an exploded perspective view of the spring clutch 150. Referring to FIG. 9, the spring clutch 150 includes a clutch gear 151, a clutch spring 159, a clutch hub 157, and a bushing 152. The bushing 152 is fixed to a first end of the cam shaft 120 and the clutch gear 151 is rotatably coupled to the bushing 152. The bushing 152 may be integrated with the cam shaft 120. The clutch spring 159 surrounds both cylindrical portions 153 and 154 of the clutch gear 151 and the bushing 152. The clutch hub 157 encompasses the clutch spring 159. Four coupling portions 158 are formed on the clutch hub 157 corresponding to the respective four cams 131. The coupling portions 158 in the present exemplary embodiment are separated from one another by approximately 90 degrees. A first end 159*a* and a second end 159*b* of the clutch spring 159 are respectively inserted into inserting holes 155 and 156 formed on the bushing 152 and the clutch hub 157. The clutch gear 151, connected to a gear 15, is rotated by the driving motor 10. The driving motor 10 rotates the clutch gear 151 in the rotation direction A, indicated by an arrow. The clutch spring 159 strongly tightens around the cylindrical portions 153 and 154 of the clutch gear 151 and the bushing 152 as the clutch spring 159 is twisted in a direction in which its inside diameter decreases. Therefore, when the clutch gear 151 rotates in the direction A, the clutch spring 159 and the bushing 152 rotates, as well as the cam shaft 120. The clutch hub 157 also rotates because the second end 159*b* of the clutch spring 159 is inserted in the inserting hole 156 of the clutch hub 157.

Figure 10:
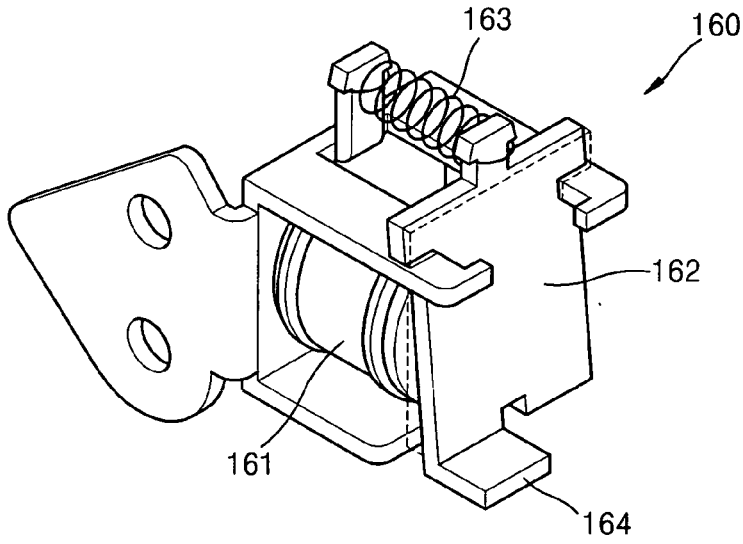
FIG. 10 is a perspective view of a solenoid of the device of FIG. 2.

FIG. 10 is a perspective view of the solenoid 160. Referring to FIG. 10, the solenoid 160 includes a coil unit 161, a moving side 162, and a spring 163. A stopper 164 is formed at one end of the moving side 162. When current is supplied to the coil unit 161, the moving side 162 adheres to the coil unit 161 as illustrated by the dashed lines. When the current is blocked, the moving side 162 returns to its original location due to the elastic force of the spring 163.

Figure 11:
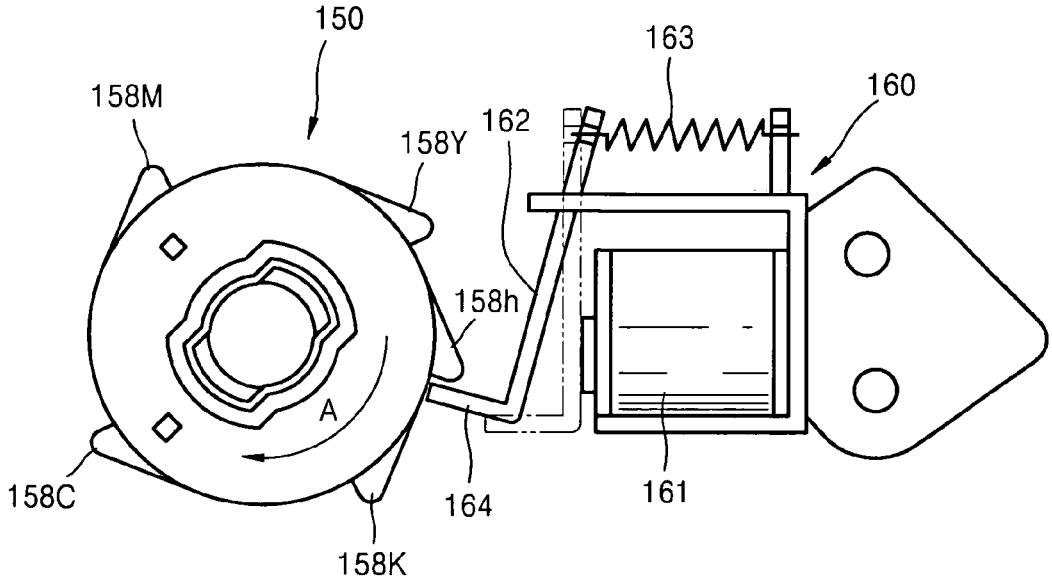
FIG. 11 is a diagram illustrating operation of the spring clutch and the solenoid of FIGS. 9 and 10.

Referring to FIGS. 9 and 11, when current is not supplied to the coil unit 161, the stopper 164 of the moving side 162 moves forward and hooks one of the coupling portions 158, thereby preventing rotation of the clutch hub 157. When the clutch hub 157 does not rotate, the clutch spring 159 is twisted such that its diameter increases because the second end 159*b* of the clutch spring 159 is inserted in the inserting hole 156 of the clutch hub 157. The friction between the clutch spring 159 and the cylindrical portion 153 of the clutch gear 151 decreases, and the clutch spring 159 and the cylindrical portion 153 of the clutch gear 151 slips, thereby fixing the clutch spring 159 and the bushing 152. Therefore, the cam shaft 120 stops rotating. When current is supplied to the coil unit 161, the moving side 162 adheres to the coil unit 161 as illustrated in the dashed lines in FIG. 11, and the stopper 164 is separated from the coupling portion 158. As described above, the cam shaft 120 then rotates with the rotation of the clutch gear 151.

Figure 2:
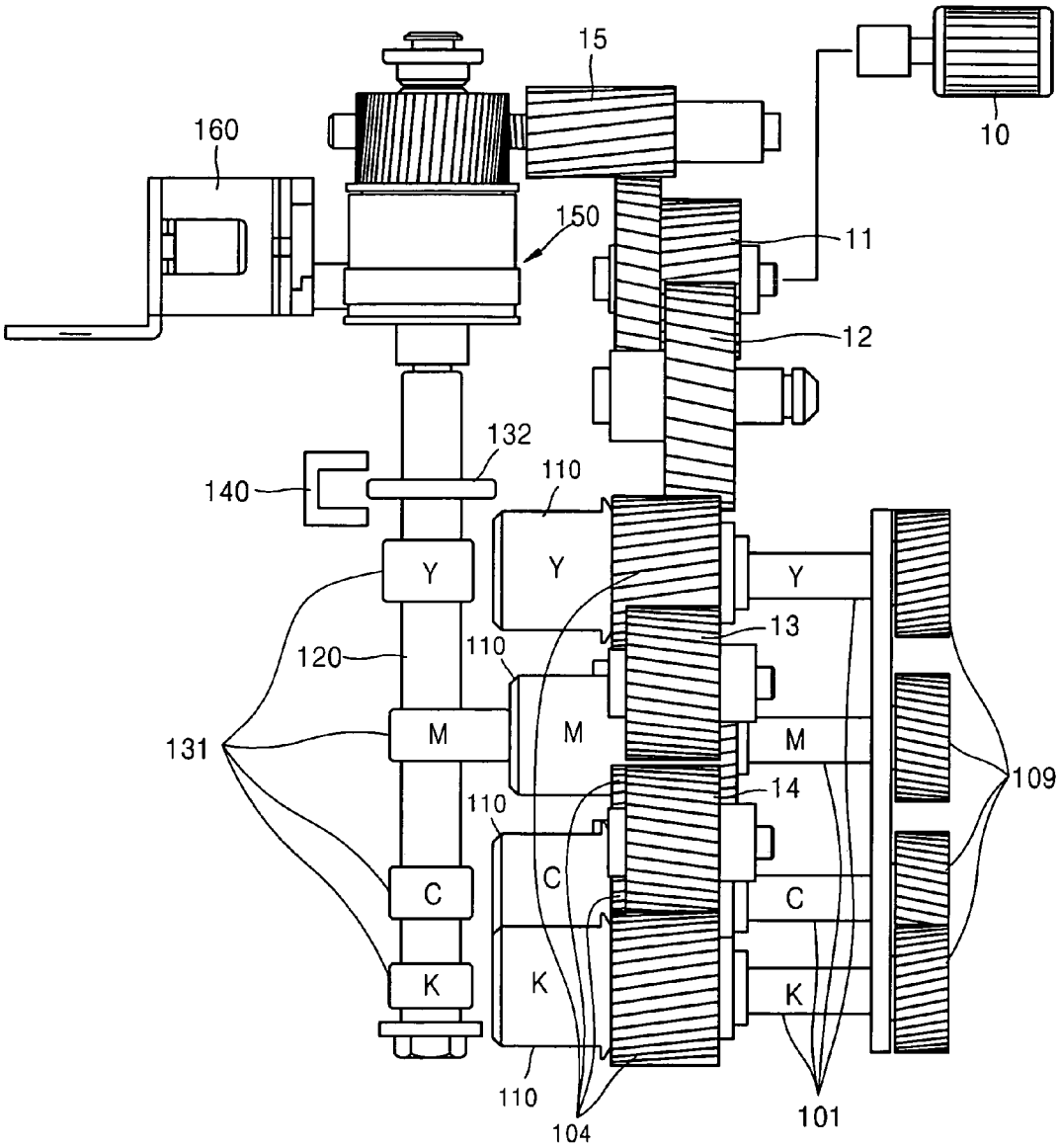
FIG. 2 is a plan view of a power transmitting device for selectively driving a plurality of developers of the apparatus of FIG. 1.
Figure 3:
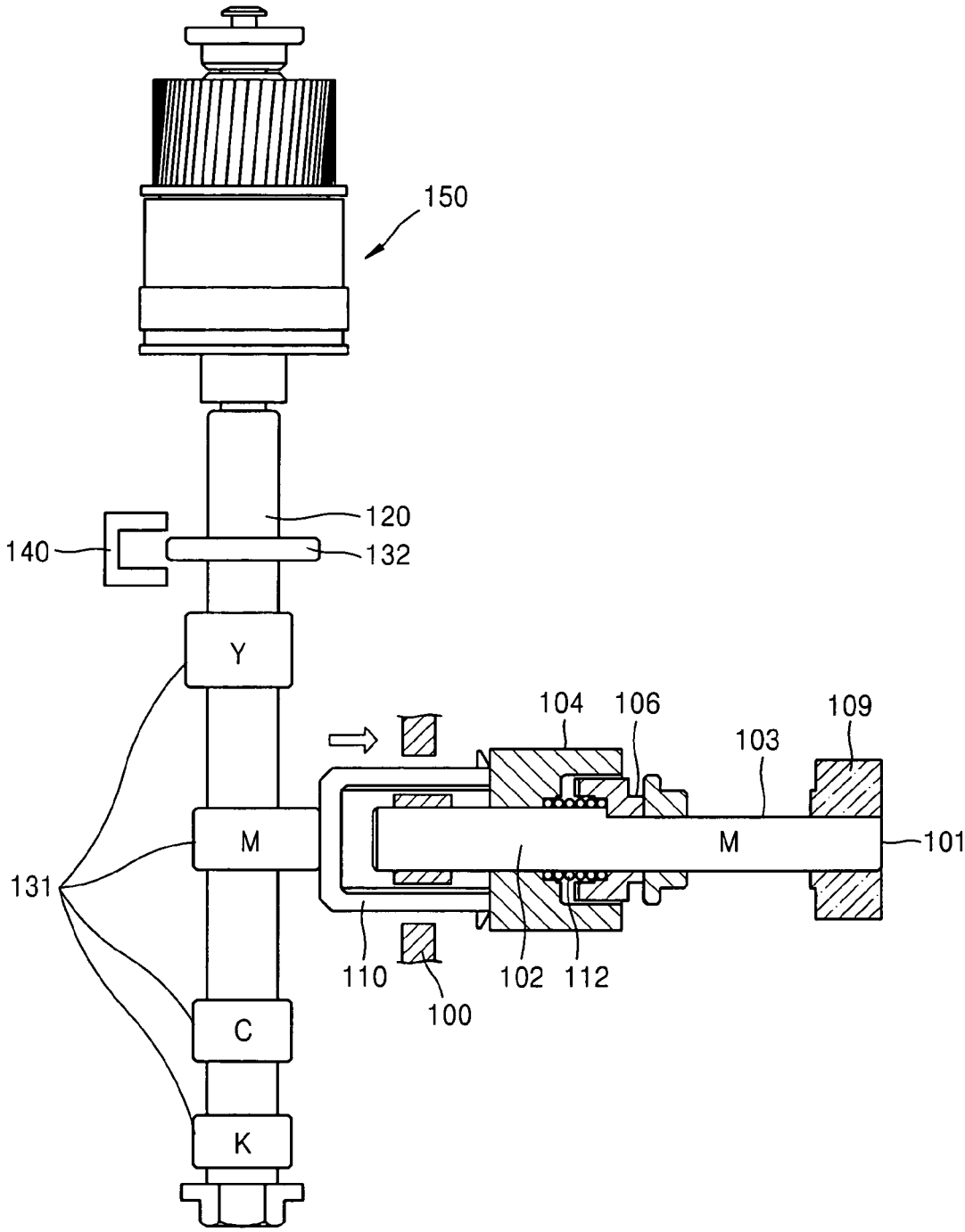
FIG. 3 is a top plan view in partial cross-sectional view of the device of FIG. 2.
Figure 4:
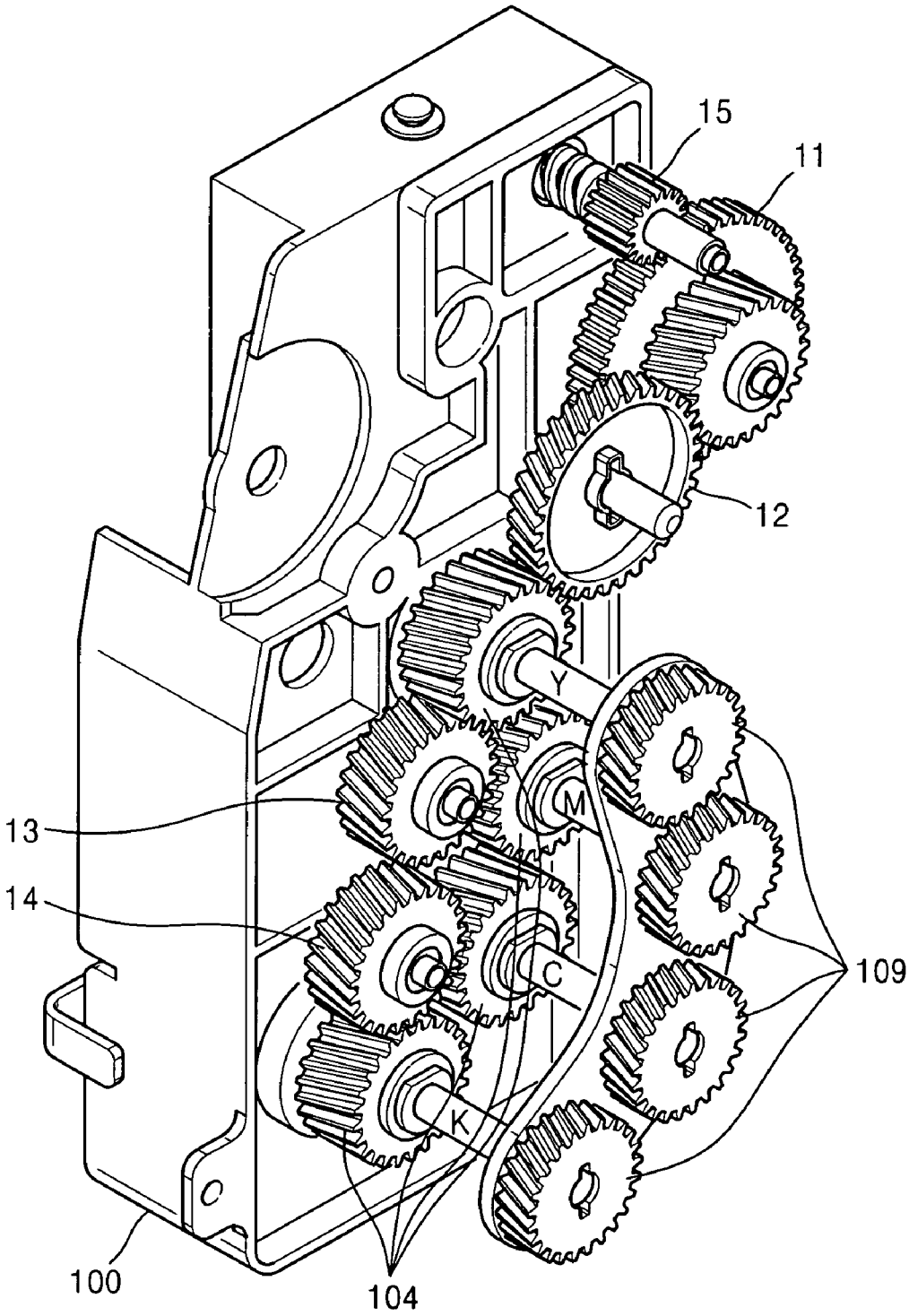
FIGS. 4 and 5 are perspective views of the device of FIG. 2.

The home position indicating element 132 is formed on the cam shaft 120 to check the initial location of the cam shaft 120, as shown in FIG. 2. A sensor 140 senses the home position indicating element 132. In the present exemplary embodiment, the sensor 140 is preferably an optical sensor. A home position coupling portion 158*h* corresponding to the phase of the home position indicating element 132 is formed on the clutch hub 157, as shown in FIG. 11. When the stopper 164 of the solenoid 160 is coupled to the home position coupling portion 158*h*, the cam shaft 120 stops rotating while located at a home position. In an exemplary embodiment of the present invention, the home position is when the four developing units 4 are not driven, that is, when the four sliding and fixed hubs 104 and 106 are separated from one another. Therefore, the phase of the home position indicating element 132 does not overlap with the phases of the four coupling portions 158. Phase-wise, the home position indicating element 132 precedes the home position coupling portion 158*h*. When current supplied to the solenoid 160 is blocked after the home position indicating element 132 is sensed by the sensor 140, the moving side 162 moves to the location indicated by the solid line in FIG. 11. When the cam shaft 120 rotates and the home position coupling portion 158*h* is stopped by the stopper 164, the rotational force from the driving motor 10 is blocked and the cam shaft 120 stops at the home position.

According to the structure described above, the four cams 131 may be stopped in the home position. In this position, the four sliding hubs 104 and the four fixed hubs 106 are respectively separated from one another. According to an image forming process, an electrostatic latent image of a current color, for example, yellow, is formed on the photosensitive drum 104. When current is supplied to the coil unit 161 of the solenoid 160, the home position coupling portion 158*h* is released from the stopper 164. Then, the rotational force of the driving motor 10 is transmitted to the cam shaft 120, and thus, the cam shaft 120 rotates in the direction A indicated in FIG. 11. When current supplied to the coil unit 161 is blocked after the stopper 164 releases the home position coupling portion 158*h*, the stopper 164 returns to the location illustrated by the solid line in FIG. 11 due to the elastic force of the spring 163. As the cam shaft 120 rotates, the cam 131Y pushes the corresponding push cap 110Y to couple the corresponding sliding hub 104Y and the fixed hub 106Y. When the coupling portion 158Y is coupled to the stopper 164, the rotational force transmitted from the driving motor 10 to the cam shaft 120 via the spring clutch 150 is blocked, and thus the cam shaft 120 stops rotating.

After the developing and intermediary transferring of the yellow color is completed, developing of the subsequent color, which may be the magenta color is started. When current is supplied to the coil unit 161 of the solenoid 160, the stopper 164 releases the coupling portion 158Y. Then, the rotational force of the driving motor 10 is transmitted to the cam shaft 120, thereby rotating the cam shaft 120 in the direction A indicated in FIG. 11. When the current supplied to the coil unit 161 is blocked after the stopper 164 releases the coupling portion 158Y, the stopper 164 returns to the location illustrated by the solid line in FIG. 11 due to the elastic force of the spring 163. As the cam shaft 120 rotates, the cam 131Y is separated from the corresponding push cam 110Y. Then, the sliding hub 04Y is separated from the corresponding fixed hub 106Y due to the elastic force of the corresponding elastic element 112Y. The cam 131M pushes the corresponding push cap 110M to couple the corresponding sliding hub 104M and the fixed hub 106M. When the coupling portion 158M is coupled to the stopper 164, the rotational force transmitted from the driving motor 10 to the cam shaft 120 is blocked by the spring clutch 150, and the cam shaft 120 stops rotating. Only the developing unit 4M operates to develop and transfer the magenta color.

The color toner image transferred on the intermediary belt 6 is finally transferred onto print paper P. The fixing unit 9 fixes the color toner image transferred onto the print paper P by applying heat and pressure.

As described above, according to the electrophotographic image forming apparatus of exemplary embodiments of the present embodiment, the sliding hubs 104, the fixed hubs 106, the cams 131, and the cam shaft 120 are used to selectively drive the developing units 4. Therefore, the electrophotographic image forming apparatus has a competitive price compared to a conventional image forming apparatus using four electronic clutches. The electronic clutches are large and slippage can occur, resulting in components operating out of phase. According to the electrophotographic image forming apparatus of exemplary embodiments of the present embodiment, very reliable power connection and blockage is possible because the sliding hubs 104 and the fixed hubs 106 are formed with complementary shapes.

According to the electrophotographic image forming apparatus of exemplary embodiments of the present embodiment, a spring clutch 150 and a solenoid 160 are used as regulators to selectively transmit a driving force of the driving motor 10, which drives other components of the electrophotographic image forming apparatus, to the cam shaft 120 and the cam 131. Therefore, the electrophotographic image forming apparatus has a simpler structure and more reliable power control than the conventional image forming apparatus using four electronic clutches.

Figure 14:
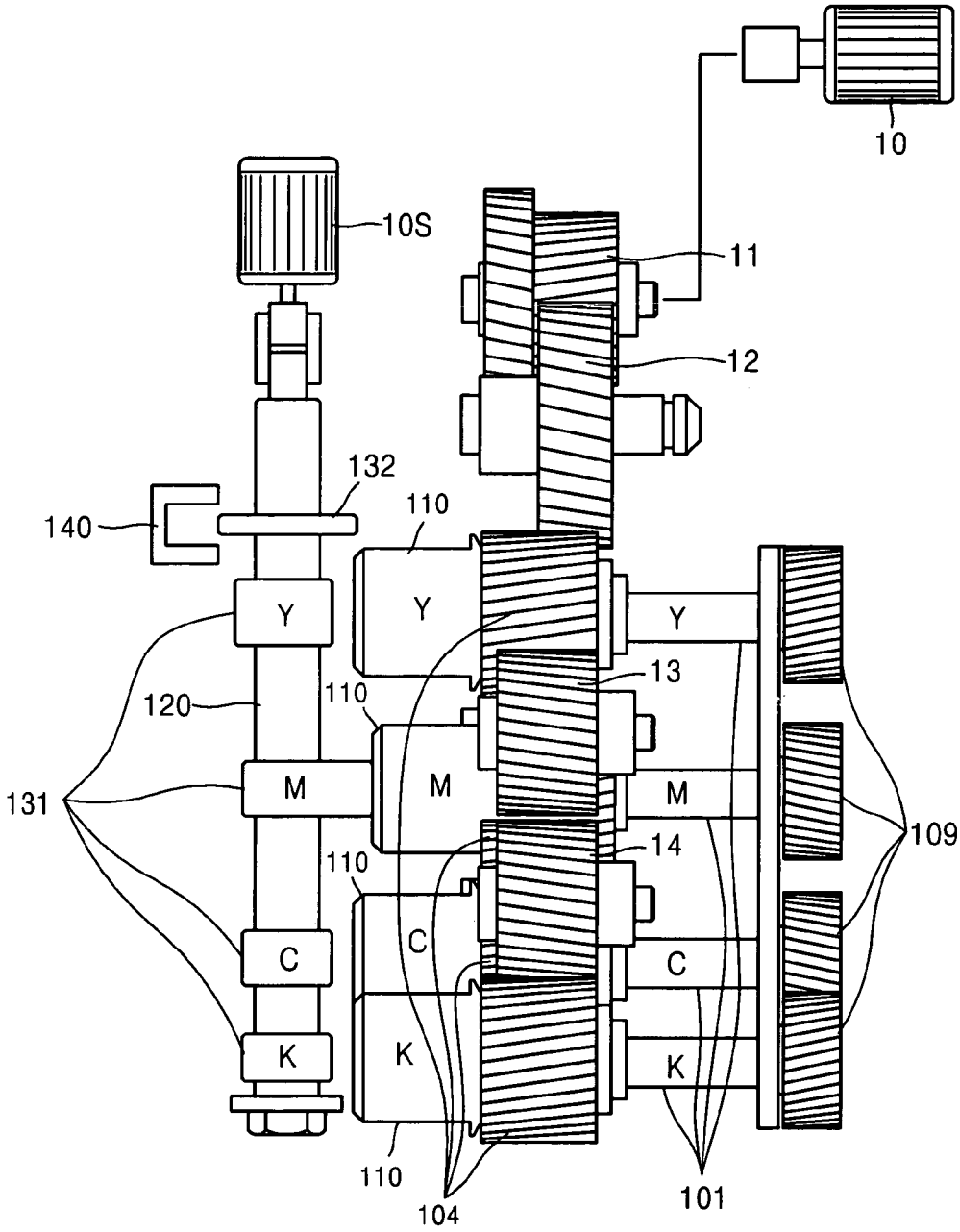
FIG. 14 is a perspective view of a power transmitting device for selectively driving a plurality of developers of an electrophotographic image forming apparatus according to another exemplary embodiment of the present invention.

A separate motor 10S (see FIG. 14) may be used to rotate the cam shaft 120. The spring clutch 150 and the solenoid 160 are not required. The motor 10S may be a stepping motor. First, a home position of the cam shaft 120 is checked by sensing the home position indicating element 132 using the sensor 140, and then the motor 10S is rotated a predetermined number of steps, thereby selectively rotating four developing units 4.

As described above, an electrophotographic image forming apparatus including a plurality of sliding hubs, fixed hubs, and cams and a cam shaft to selectively couple the sliding and fixed hubs has a competitive price compared to a conventional image forming apparatus including a plurality of electronic clutches. The sliding and fixed hubs, formed with complementary shapes, make very reliable power transmittance and blockage possible. The simplified structure of the electrophotographic image forming apparatus with reliable power control may be configured by having a driving source that drives the cams and other components of the electrophotographic image forming apparatus by using a spring clutch and a solenoid to control the power. The structure of the electrophotographic image forming apparatus may be further simplified by using a stepping motor to drive the cams.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus, comprising:

a plurality of developing units;

a cam shaft;

a plurality of cams disposed on the cam shaft corresponding to the respective plurality of developing units;

a power transmitting device disposed between the plurality of developing units and the plurality of cams to selectively transmit rotational force from a driving source to the plurality of developing units;

a plurality of fixed hubs respectively connected to the plurality of developing units; and a plurality of sliding hubs connected to the driving source and adapted to respectively slide to selectively connect to the plurality of fixed hubs.

2. The electrophotographic image forming apparatus of claim 1, wherein pairs of the fixed hubs and the sliding hubs are respectively disposed on the same axis.

3. The electrophotographic image forming apparatus of claim 2, wherein a plurality of elastic elements respectively elastically bias the sliding hubs away from the fixed hubs.

4. The electrophotographic image forming apparatus of claim 1, wherein the cam shaft has a plurality of cam shafts connected by a universal joint.

5. The electrophotographic image forming apparatus of claim 1, wherein a connection element pushes one of the plurality of sliding hubs when pivoted by one of the plurality of cams.

6. The electrophotographic image forming apparatus of claim 1, wherein the cam shaft is rotated by the driving source, and a regulating element regulates the rotational force transmitted from the driving source to the cam shaft.

7. The electrophotographic image forming apparatus of claim 6, wherein the regulating element includes a spring clutch disposed between the driving source and the cam shaft, and having a plurality of coupling portions corresponding to the phases of the cams; and an actuator selectively coupled to the coupling portions to selectively operate the spring clutch.

8. The electrophotographic image forming apparatus of claim 7, wherein a home position indicating element is formed on the cam shaft;

a sensor senses the home position indicating element; and the spring clutch has a home position coupling portion located at substantially the same phase as the home position indicating element.

9. The electrophotographic image forming apparatus of claim 8, wherein the phase of the home position coupling portion does not overlap with the phases of the coupling portions.

10. The electrophotographic image forming apparatus of claim 1, wherein a step motor rotates the cam shaft;

a home position indicating element is formed on the cam shaft; and a sensor senses the home position indicating element.

11. A multi-pass-type electrophotographic image forming apparatus that sequentially develops a single-color toner image on a photosensitive drum using a plurality of developing units facing the photosensitive drum and prints a color image by transferring the single-color toner images on top of each other on an intermediary transfer medium, the electrophotographic image forming apparatus, comprising:

a plurality of fixed hubs respectively connected to the developing units;

a plurality of sliding hubs connected to a driving source and slidably disposed on the same axis as the fixed hubs;

a plurality of elastic elements that respectively elastically bias the sliding hubs away from the fixed hubs;

a cam shaft; and a plurality of cams disposed on the cam shaft corresponding to the respective sliding hubs, and selectively slide the sliding hubs according to a rotational phase of the cam shaft to connect the sliding hubs to the fixed hubs.

12. The electrophotographic image forming apparatus of claim 11, wherein a connection element pushes a sliding hub when pivoted by a cam; and at least one of the cams slides one of the sliding hubs via the connection element.

13. The electrophotographic image forming apparatus of claim 12, wherein the cam shaft is rotated by the driving source;

a spring clutch is disposed between the driving source and the cam shaft, and has a plurality of coupling portions corresponding to the phases of the cams; and an actuator is selectively coupled to the coupling portions to selectively operate the spring clutch.

14. The electrophotographic image forming apparatus of claim 13, wherein a home position indicating element formed on the cam shaft;

a sensor senses the home position indicating element; and the spring clutch has a home position coupling portion located at the same phase as the home position indicating element.

15. The electrophotographic image forming apparatus of claim 11, wherein each of the developing units has a developing roller; and the developing units are disposed at a distance from the photosensitive drum substantially equal to a developing gap.

16. A multi-pass-type electrophotographic image forming apparatus that sequentially develops a single-color toner image on a photosensitive drum using a plurality of developing units facing the photosensitive drum and prints a color image by transferring the single-color toner images on top of each other on an intermediary transfer medium, the electrophotographic image forming apparatus, comprising:

a plurality of fixed hubs respectively connected to the developing units;

a plurality of sliding hubs connected to a driving source and slidably disposed on the same axis as the fixed hubs;

a plurality of elastic elements that respectively elastically bias the sliding hubs away from the fixed hubs;

a first cam shaft and a second cam shaft connected via a universal joint; and a plurality of cams disposed on the first and second cam shafts corresponding to the sliding hubs, and that selectively slide the sliding hubs according to a rotational phase of the first or second cam shaft to connect the sliding hubs to the fixed hubs.

17. The electrophotographic image forming apparatus of claim 16, wherein the first cam shaft is rotated by the driving source;

a spring clutch is disposed between the driving source and the first cam shaft, and has a plurality of coupling portions corresponding to the phases of the cams; and an actuator is selectively coupled to the coupling portions to selectively operate the spring clutch.

18. The electrophotographic image forming apparatus of claim 17, wherein a home position indicating element formed on one of the first and second cam shafts;

a sensor senses the home position indicating element; and the spring clutch includes a home position coupling portion located at the same phase as the home position indicating element.

19. The electrophotographic image forming apparatus of claim 16, wherein each of the developing units has a developing roller; and the developing units are disposed at a distance from the photosensitive drum substantially equal to a developing gap.

20. An electrophotographic image forming apparatus, comprising:

a plurality of developing units;

a cam shaft;

a plurality of cams disposed on the cam shaft corresponding to the respective plurality of developing units and mechanically interacting with the respective plurality of developing units to selectively transmit rotational force from a driving source to the respective plurality of developing units; and a power transmitting device disposed between the plurality of developing units and the plurality of cams, the plurality of cams mechanically interacting with the respective plurality of developing units through the power transmitting device to selectively transmit rotational force from a driving source to the plurality of developing units, wherein the power transmitting device includes a plurality of members moved axially by rotation of the plurality of cams.

21. The electrophotographic image forming apparatus of claim 20, wherein the plurality of developing units are fixedly positioned.

* * * * *